US005671846A

United States Patent [19]

Frank

[11] Patent Number: 5,671,846

[45] Date of Patent: Sep. 30, 1997

[54] PORTABLE PICNIC SALAD BAR

[76] Inventor: Richard Frank, 548 Eldon Dr., NW., Warren, Ohio 44483

[21] Appl. No.: 650,042

[22] Filed: May 17, 1996

[51] Int. Cl.[6] ..... B65D 1/24

[52] U.S. Cl. ..... 206/541; 206/549; 220/524; 220/306; 190/111

[58] Field of Search ..... 206/541, 542, 206/543, 547, 549, 214, 223; 190/109–111; 220/522, 524, 526, 306; 426/119, 120

[56] References Cited

U.S. PATENT DOCUMENTS

| | | | |
|---|---|---|---|
| 2,211,816 | 8/1940 | Heise | 206/541 |
| 2,496,296 | 2/1950 | Lobl . | |
| 2,672,232 | 3/1954 | Kessell, Jr. | 206/543 |
| 3,178,903 | 4/1965 | Proctor . | |
| 4,067,475 | 1/1978 | Pinkau et al. . | |
| 4,545,487 | 10/1985 | Asmus . | |
| 4,852,741 | 8/1989 | Van Benschoten . | |
| 4,936,462 | 6/1990 | Yuen | 206/542 |
| 5,277,329 | 1/1994 | Pomroy et al. | 220/526 |
| 5,363,978 | 11/1994 | Molo | 220/306 |

OTHER PUBLICATIONS

Cambro 1995 Product Catalog.

*Primary Examiner*—Paul T. Sewell
*Assistant Examiner*—Luan K. Bui
*Attorney, Agent, or Firm*—Harpman & Harpman

[57] ABSTRACT

A self-contained portable salad bar formed of two interconnected containers that are secured together for transportation to a remote location. Each of the containers define a plurality of individual receptacles with associated closures. The interconnected containers are secured together by an interconnecting locking bar latch mechanism forming a transportable closed case with a transportation carrying strap exposed.

8 Claims, 2 Drawing Sheets

PORTABLE PICNIC SALAD BAR

BACKGROUND OF THE INVENTION

1. Technical Field

This invention relates to transportable food containers more particularly to salad containers that are used to temporary store and dispense fresh salad components at a remote location from a single unit.

2. Description of Prior Art

Prior art devices of this type have relied on a variety of different enclosures designed to hold and transport food stuff to remote locations. Such containers usually have a number of storage areas within a single or unitized interconnected relationship for transportation and storage, see for example U.S. Pat. Nos. 2,496,296, 3,178,903, 4,067,475, 4,545,487, 4,852,741 and Cambro 1995 product catalog, pgs. 66, 67 and 104 disclosing carriers with insertable compartments and multiple covers secured by hinged lids.

In U.S. Pat. No. 2,496,296 a portable refrigerated container is disclosed having multiple compartments with associated removable freezer inserts.

U.S. Pat. No. 3,178,903 is directed to a food preserver having a number of food containers in an enclosure with an insulated receiving area for dry ice.

A container for food stuff is disclosed in U.S. Pat. No. 4,067,475 in which multiple interlocking dish shaped containers are secured to one another.

In U.S. Pat. No. 4,545,487 a food serving tray is disclosed wherein multiple compartments are suspended in a spaced enclosure and are stackable in relation to one another.

Finally, in U.S. Pat. No. 4,852,741 discloses a portable table top salad bar having an insulated base with an insertable container with closure.

SUMMARY OF THE INVENTION

A portable self-contained container and server for vegetable, salads and the like wherein a plurality of individually resealable compartments are positioned in opposing overlapping relation to one another with an interconnected containment areas that are registerably secured to one another by hinged elements when closed providing a non-accessible transportable unit.

DESCRIPTION OF THE PREFERRED EMBODIMENT

Figure 1:
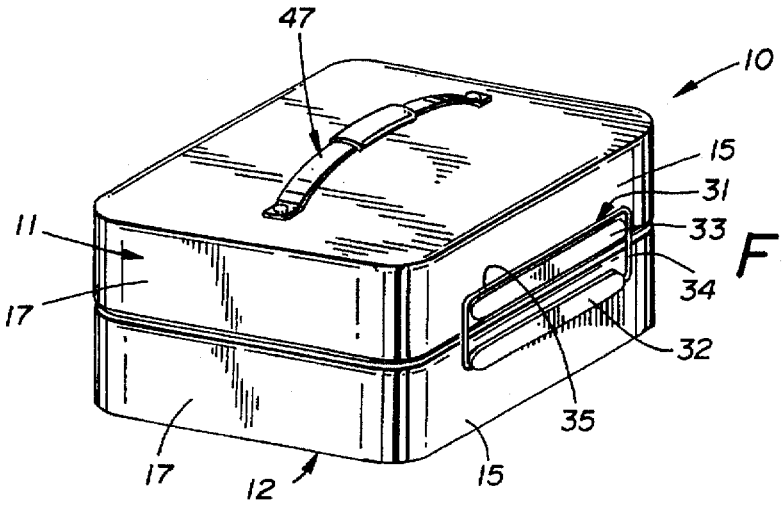
FIG. 1 is a perspective view of the invention in closed transportable form.
Figure 2:
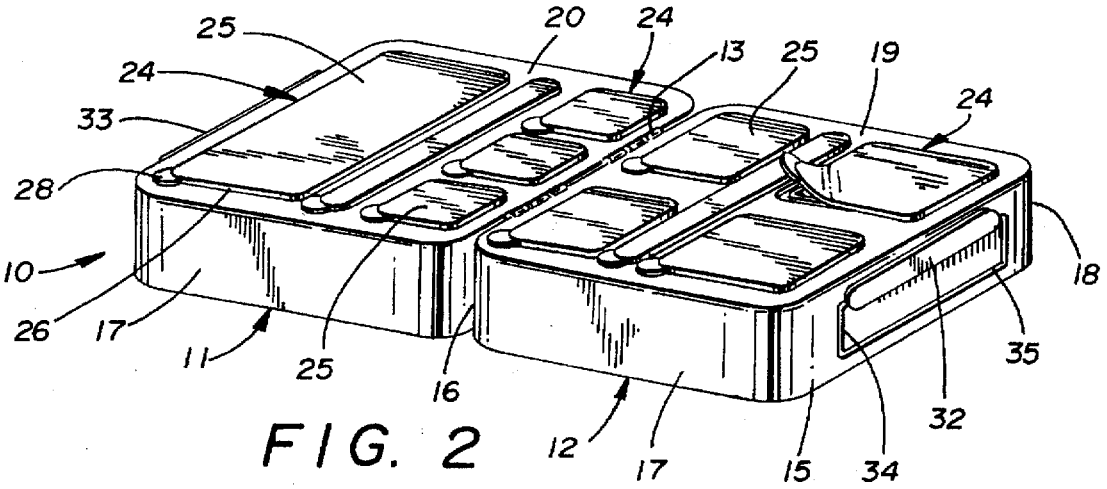
FIG. 2 is a perspective view of the invention shown in FIG. 1 in open position.
Figure 3:
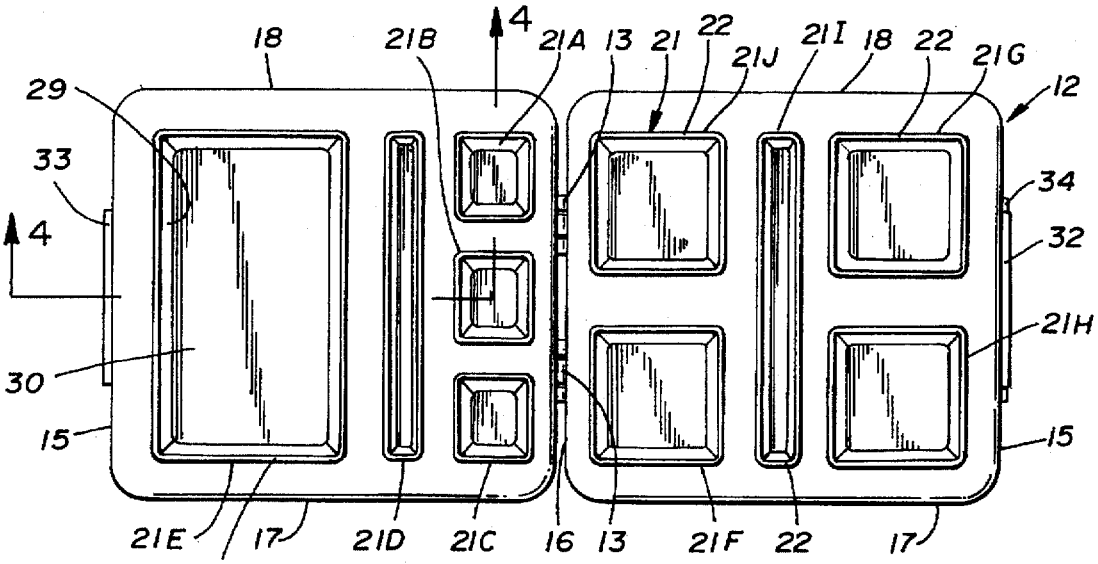
FIG. 3 is a top plan view of the invention illustrating container placement and positioning.
Figure 4:
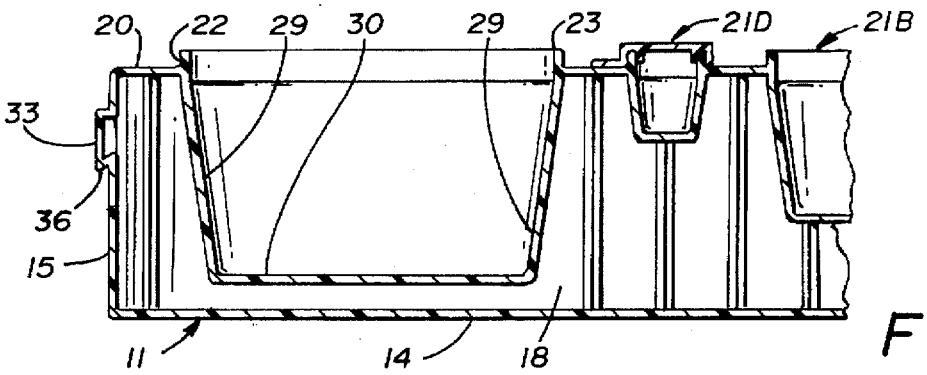
FIG. 4 is a cross-sectional view on lines 4—4 of FIG. 3.
Figure 5:
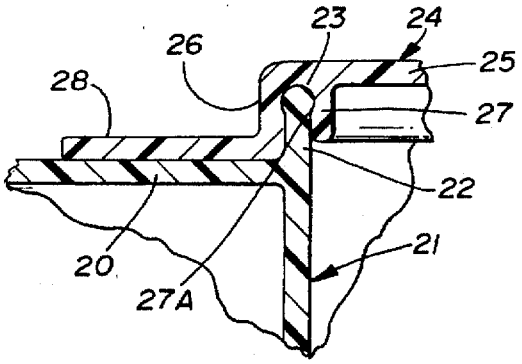
FIG. 5 is an enlarged cross-section of the closure lip of a container.

Referring to FIGS. 1, 2 and 3 of drawings, a portable salad bar 10 can be seen having a first container body 11 and a second container body 12 pivotally secured to one another by hinge elements 13. Each container body 11 and 12 has a base 14, multiple upstanding sidewalls 15, 16, 17, and 18 and respective integral top portions 19 and 20 interconnecting said respective walls 15–18. Each of the top portions 19 and 20 have a number of recesses therein defining integral wells 21, each having respective upstanding container rims 22 thereabout as best seen in FIGS. 3–5 of the drawings. The rims 22 have beaded upper edges 23 for registration with respective sized closures 24 defining a top 25 with a descending perimeter skirt 26. An annular sealing flange 27 extends from said top 25 in spaced horizontal relation to said skirt 26 defining a bead registration channel therebetween. The annular flange 27 is contoured along its outer surface 27A facing the perimeter skirt 26 and is registerable over the hereinbefore described beaded rim 22.

Each closure 24 has an outwardly extending engagement tab 28 extending from one corner thereof to provide a gripping surface so as to effect removal of the sealed closure from the beaded respective upstanding rims 22 as will be well known to those skilled in the art.

The closures 24 are made of pliable synthetic resin material and are preferably transparent for viewing the contents of the individual wells 21.

Referring now to FIGS. 3 and 4 of the drawings, the wells 21 are shown in spaced inter-relation to each other and the containers respective bases 14 and respective sidewalls 15–18 defining an open air insulation area thereabout.

Each of the wells have tapered sidewalls 29 and a relatively flat bottom 30 in this embodiment and are of varying dimensions arranged in a selective patter dependent on size, see FIG. 3 of the drawings. In the embodiment chosen for illustration the position of the different sized wells 21 are arranged in a distinctive pattern in the container body 12 wherein three of the wells 21A, 21B, and 21C are closest to the hinge element 13. Well 21D is elongated and well 21E is the largest of the wells illustrated and is of a generally rectangular configuration. Correspondingly, the wells arrangement in the container body 12 has four generally square well configurations 21E, F, G, and H in aligned pairs with an elongated well 21I therebetween.

Referring to FIG. 2 of the drawings, it will be seen that the foregoing arrangement of multiple wells within the respective interconnected container bodies 11 and 12 with respective closures 24 in place will overlap one another upon closure of said containers as seen in FIG. 1 of the drawings and illustrated by broken lines in FIG. 3. It will be evident that the overlapping relationship of the intervening wells (21G, H and I by 21F for example) that the top portion 19–20 of the contoured bodies 11 and 12 in closed position will be vertically spaced in relation to one another due to the engagement with the elevated nature of the abutting closures 24 on the respective upstanding rims 22.

Figure 6:
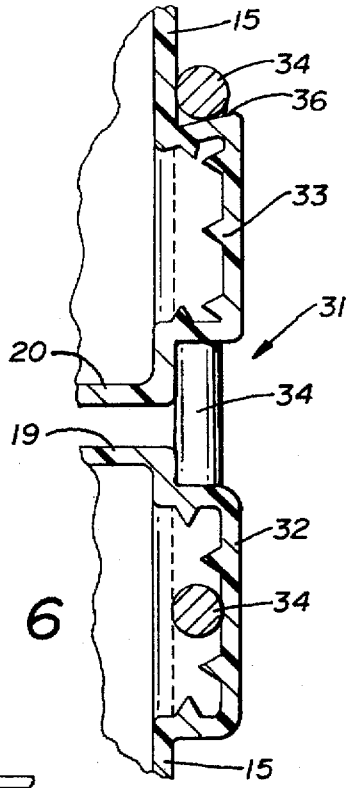
FIG. 6 is an enlarged cross-section of the locking latch of the invention.

Referring to FIGS. 1, 2 and 6 of the drawings, a latch assembly 31 can be seen having an elongated mounting and engagement members 32 and 33 respectively on the respective sidewalls 15 of the container body members 11 and 12. A latching bracket 34 pivotally extends from said member 32. Said latching bracket 34 has an engagement portion that is registerable over the engagement member 33 on the contoured body member 11. The engagement member 33 is of an elongated rectangular configuration having a tapered upper surface 36, best seen in FIG. 6 of the drawings, as will be well understood by those skilled in the art for registration and capture of the latch configuration.

Figure 7:
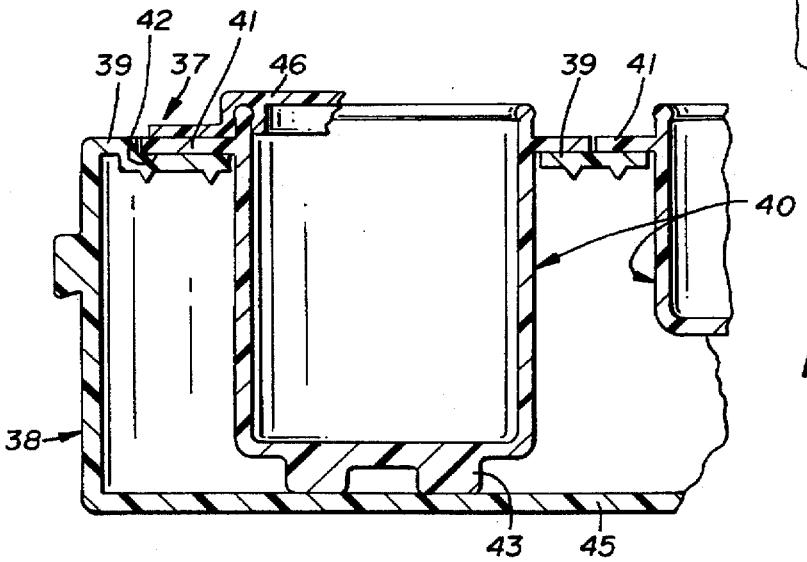
FIG. 7 is a partial cross-sectional view of an alternate form of the invention.

Referring now to FIG. 7 of the drawings, an alternate form of the invention 37 can be seen wherein modified contoured bodies 38 having apertured top portions 39 define multiple size openings therein for the insertion of individually sized receptacles 40, each of which has an annular supporting flange 41 extending therefrom which is engageable in a registering recessed area 42 about each of said openings. Each of the respective receptacles 40 have support elements 43 extending therefrom for registration with a base portion 45 of each of the container bodies 38 and closures 46 as in the preferred embodiment 10 hereinbefore described.

Both the preferred form of the invention illustrated in FIGS. 1–6 and the alternate form 37 in FIG. 7 have a transport handle strap 47 on their respective base portions 14 and 45 that when in closed position as illustrated in FIG. 1 defines a carrying strap means.

It will therefore be seen that a new and unique portable picnic salad bar has been illustrated and described herein and that various changes and modifications may be made therein without departing from the spirit of the invention.

Therefore I claim:

1. A portable self-contained foldable salad bar comprises; a first container body and a second container body hinged to one another, said container bodies having top portions, a plurality of wells formed in said respective top portions, upstanding rims on said top portions about each of said wells, resealable flexible closures registerable on said rims defining a multiplicity of food receiving compartments in each container body, said flexible closures having engagement tabs extending therefrom said container bodies registerable together forming an integral unit for transportation, latching means on said container bodies comprising a substantially identical mounting member and an engagement member on said respective bodies, means pivotally extending from said mounting member registerable over said engagement member, each of said closures on each of said respective container bodies registerable against one another in overlapping relationship one of said closures on said second container body registerable over multiple closures in said first container body upon closure of first container body against said second container body.

2. The portable self-contained foldable salad bar of claim 1 wherein said container bodies comprise a base, interconnecting sidewalls and an integral top.

3. The portable self-contained foldable salad bar of claim 1 wherein said each of said wells have tapered sides and a generally flat bottom in said relation to said container body.

4. The portable self-contained foldable salad bar of claim 1 wherein said means pivotally secured to said mounting member on one of said engagement members comprises an elongated rectangular shaped rod.

5. The portable self-contained foldable salad bar of claim 1 wherein said container bodies are molded of a rigid synthetic resin material.

6. The portable self-contained foldable salad bar of claim 1 wherein said closures are made of flexible transparent synthetic resin material.

7. The portable self-contained foldable salad bar of claim 1 wherein said second container body has a handle strap extending from its base portion.

8. The portable self-contained foldable salad bar of claim 1 wherein said engagement member has a tapered top portion.

* * * * *